US005921183A

United States Patent [19]

Jones

[11] Patent Number: 5,921,183

[45] **Date of Patent: *Jul. 13, 1999**

[54] NARROW GAP PLATE WITH INSERTABLE LOCK-UP MECHANISM, AND METHOD OF USING THE SAME

[75] Inventor: Jackson Hacker Jones, Rochester, N.H.

[73] Assignees: Heidelberger Druckmaschienen AG, Heidelberg, Germany; Heidelberg Harris, Inc., Dover, N.H.

[ * ] Notice: This patent issued on a continued prosecution application filed under 37 CFR 1.53(d), and is subject to the twenty year patent term provisions of 35 U.S.C. 154(a)(2).

[21] Appl. No.: 08/813,608

[22] Filed: Feb. 14, 1997

[51] Int. Cl.[6] ..... B41F 27/00

[52] U.S. Cl. ..... 101/483; 101/415.1; 101/477

[58] Field of Search ..... 101/415.1, 477, 101/479, 378, 212, 216, 382.1, 383

[56] References Cited

U.S. PATENT DOCUMENTS

| | | | |
|---|---|---|---|
| 2,900,904 | 8/1959 | Hantscho | 101/415.1 |
| 3,161,129 | 12/1964 | Taylor | 101/212 |
| 3,633,246 | 1/1972 | Kirkpatrick | 101/415.1 |
| 3,885,486 | 5/1975 | Kirkpatrick et al. | 101/415.1 |
| 4,739,704 | 4/1988 | Kitai | 101/415.1 |
| 5,178,068 | 1/1993 | Junghans et al. | 101/415.1 |
| 5,396,843 | 3/1995 | Dürr | 101/415.1 |
| 5,467,711 | 11/1995 | Maejima | 101/477 |
| 5,553,544 | 9/1996 | Ramsay | 101/415.1 |
| 5,642,668 | 7/1997 | Schaede et al. | 101/415.1 |
| 5,711,222 | 1/1998 | Taylor et al. | 101/183 |

FOREIGN PATENT DOCUMENTS

| | | |
|---|---|---|
| 993 798 | 11/1951 | France . |
| 339 092 | 9/1929 | Germany . |
| 44 01 201 | 7/1995 | Germany . |
| 44 15 622 | 11/1995 | Germany . |
| 309279 | 2/1997 | Japan . |

*Primary Examiner*—Eugene Eickholt
*Attorney, Agent, or Firm*—Kenyon & Kenyon

[57] ABSTRACT

An apparatus and method which allows a printing plate to be mounted onto a plate cylinder in a quick and efficient manner. The apparatus includes a lock-up mechanism which is removable from the plate cylinder, and which is preferably slidably received in an axial slot in the plate cylinder. The axial slot may include a mechanism for retaining the lock-up mechanism once it is inserted in the axial slot, and for tensioning the plate on the plate cylinder. The method of the invention includes a first step of removing the lock-up mechanism from the plate cylinder and unlocking the lock-up mechanism. A flat plate has both its ends bent approximately 90°, and then the plate is bent into a cylindrical shape. The bent ends of the plate, which after the cylindrical bending are approximately parallel to one another, are then inserted into the lock-up mechanism. The lock-up mechanism is thereafter locked, clamping the ends of the plate into the previously-bent cylindrical shape. Compressed air is forced through outlets on the plate cylinder while the plate/lock-up mechanism unit is inserted onto the plate cylinder. The compressed air causes the plate to slightly expand and also produces an air bearing between the plate cylinder and the plate, thereby easing insertion of the plate on the plate cylinder. The lock-up mechanism is slid into an axial slot on the plate cylinder. Thereafter, the lock-up mechanism is secured to the plate cylinder.

29 Claims, 8 Drawing Sheets

Fig.4
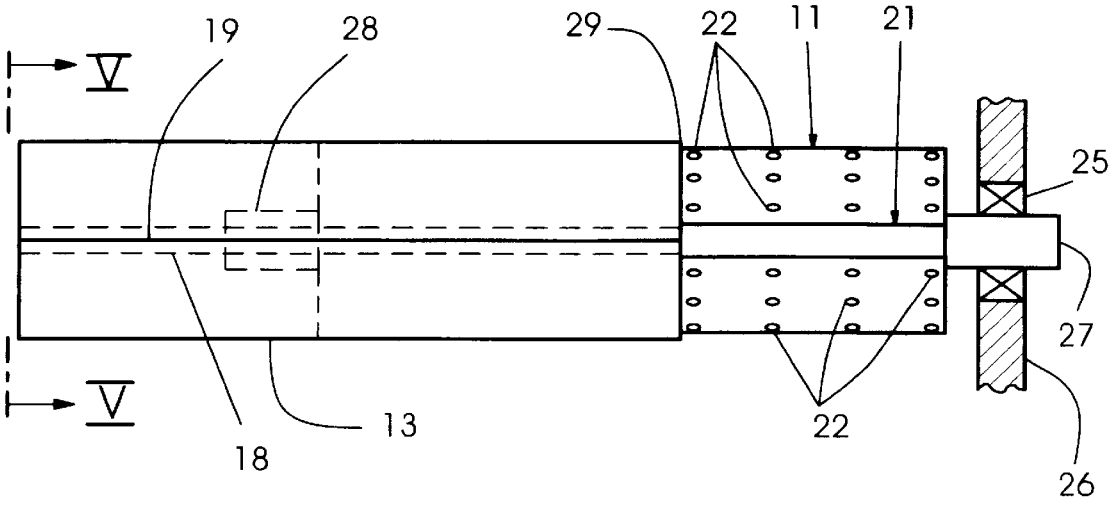
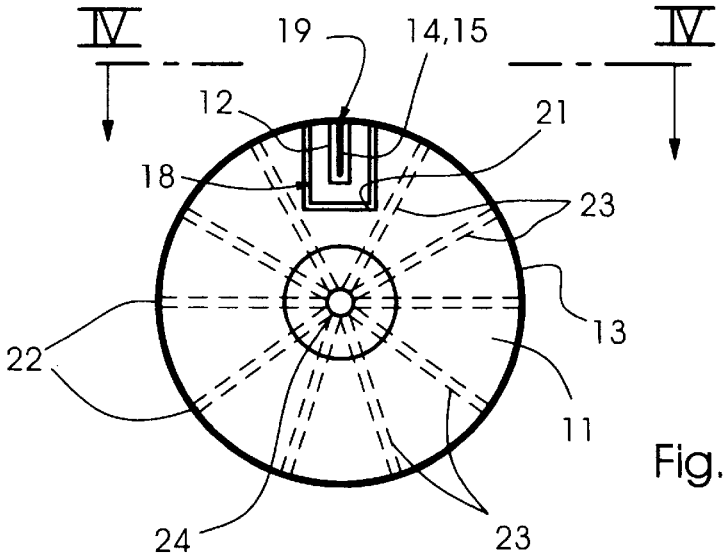
Fig.5

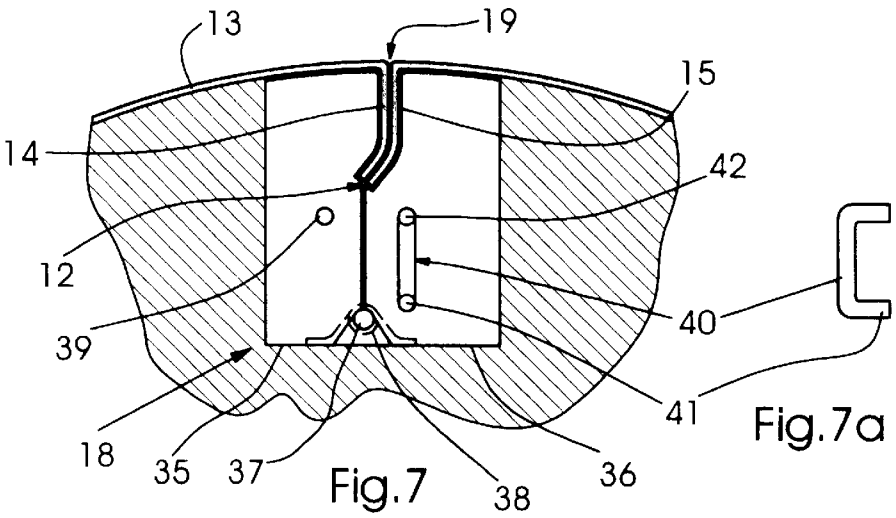
Fig.7
Fig.7a
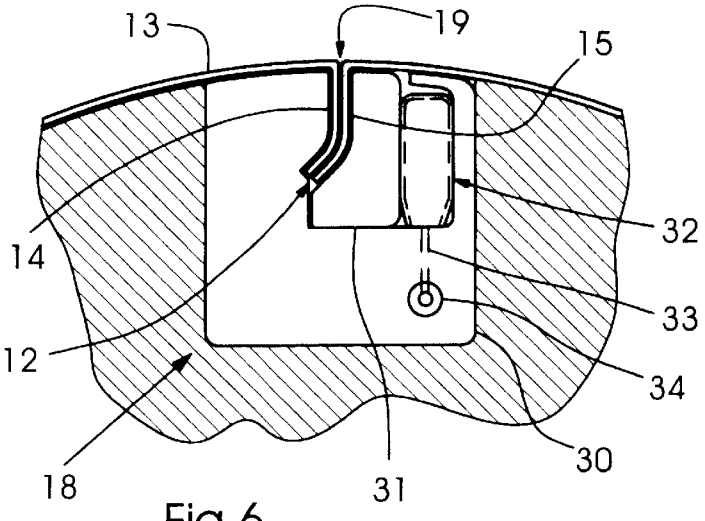
Fig.6
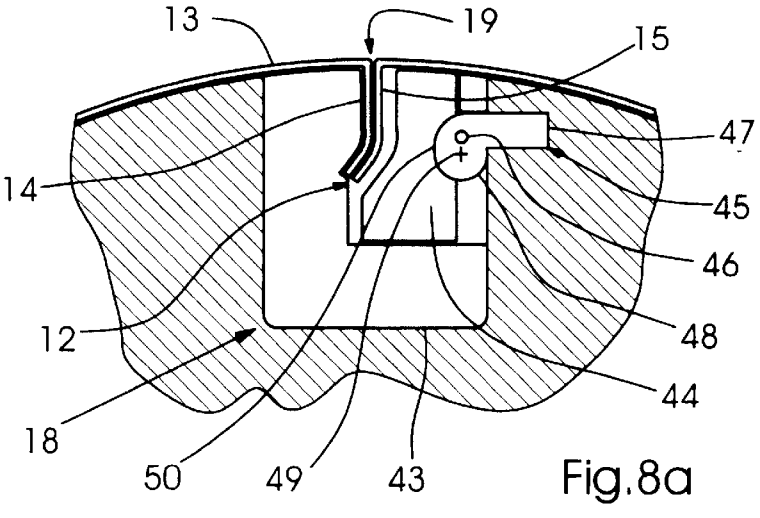
Fig.8a
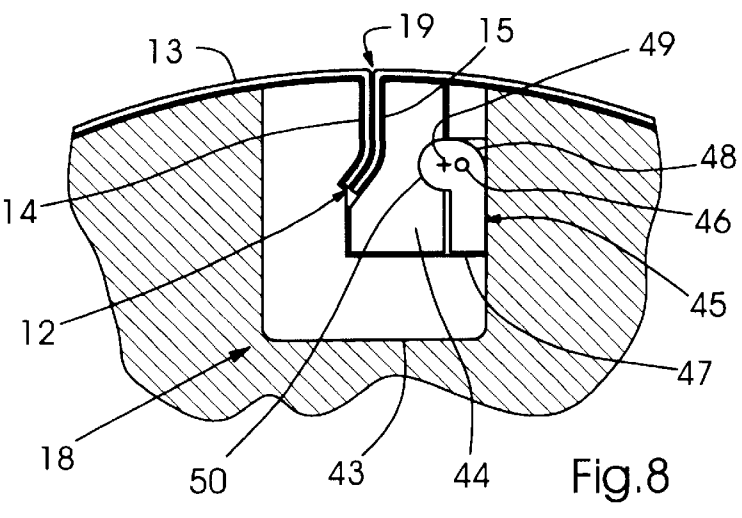
Fig.8

NARROW GAP PLATE WITH INSERTABLE LOCK-UP MECHANISM, AND METHOD OF USING THE SAME

BACKGROUND OF THE INVENTION

1. Field of the Invention

The present invention relates to a plate lock-up mechanism used to mount a printing plate in an offset printing press, and a method for using that mechanism. In particular, the present invention relates to an apparatus and method for locking up a conventional, flat, printing plate into a cylindrical form prior to mounting of the plate on the plate cylinder of the offset printing press, to thereby ease the mounting or changing of the printing plate onto the plate cylinder.

2. Description of the Prior Art

Various prior art devices have been developed to make easier the mounting or changing of printing plates on the plate cylinder of a offset printing press. U.K. Published Patent Application No. 2 286 365 describes one prior art device for the quick exchange of printing plates on plate cylinders of a printing press. In the device shown in that publication, shown in FIGS. 1 and 2 of the present specification, the plate cylinder 1 includes an axial slot 2, and a side wall of the press includes an aperture (not shown). The printing plate 3 is bent into a cylindrical shape prior to being mounted on the plate cylinder 1. The ends 4, 5 of the plate 3 are bent and formed with a rounded edge 6 and a hook 7 to lock together and hold the plate 3 in the cylindrical shape. The cylindrically-bent and locked plate is then slid onto the plate cylinder 1 through the aperture in the press, such that the locked ends 4, 5 are inserted into the axial slot 2 in the plate cylinder 1. A lock-up mechanism 8 in the slot 2 is then engaged to lock the plate 3 to the plate cylinder 1.

A problem with the prior art device described above is that it requires complicated and sometimes difficult to make bends in the ends of the plate in order to hold the plate ends together during the mounting and lock-up operations.

SUMMARY OF THE INVENTION

The present invention is an apparatus and method which allows a printing plate to be mounted onto a plate cylinder in a quick and efficient manner. The apparatus includes a lock-up mechanism which is removable from the plate cylinder, and which is preferably slidably received in an axial slot in the plate cylinder. The axial slot may include a mechanism for retaining the lock-up mechanism once it is inserted in the axial slot, and for tensioning the plate on the plate cylinder.

The method of the invention includes a first step of removing the lock-up mechanism from the plate cylinder and unlocking the lock-up mechanism. A flat plate cylinder has both its ends bent approximately 90°, and then the plate is bent into a cylindrical shape. The bent ends of the plate, which after the cylindrical bending are approximately parallel to one another, are then inserted into the lock-up mechanism. The lock-up mechanism is thereafter locked, clamping the ends of the plate into the previously-bent cylindrical shape. The plate/lock-up mechanism unit is then inserted onto the plate cylinder. Preferably, the plate cylinder include a series of compressed air outlets around the periphery of the plate cylinder. Compressed air is forced through these outlets while the plate/lock-up mechanism unit is inserted onto the plate cylinder. The compressed air causes the plate to slightly expand and also produces an air bearing between the plate cylinder and the plate, thereby easing insertion of the plate on the plate cylinder. The lock-up mechanism is slid into an axial slot on the plate cylinder. Thereafter, the lock-up mechanism is secured to plate cylinder.

The present invention does not require that complicated bends be made in the plate ends to hold the plate in a cylindrical shape during mounting and lock-up. The present invention is therefore much easier to use and makes mounting much less difficult than with prior art devices.

BRIEF DESCRIPTION OF THE DRAWINGS

The foregoing and other features of the present invention will become apparent to those skilled in the art to which the present invention relates from reading the following description with reference to the accompanying drawings, in which:

FIG. 4 is a top view of a plate and plate lock-up mechanism of the present invention being placed on a plate cylinder;

FIG. 5 is an end view of FIG. 4;

FIG. 6 is an end view of a first embodiment of a lock-up mechanism of the present invention;

FIG. 7 is an end view of a second embodiment of a lock-up mechanism of the present invention;

FIG. 7*a* is a side view of a spacer pin used in the embodiment of FIG. 7;

FIG. 8 is an end view of a third embodiment of a lock-up mechanism of the present invention, in a locked condition;

FIG. 8*a* is an end view of the embodiment of FIG. 8, in an unlocked condition;

DETAILED DESCRIPTION OF THE INVENTION

Figure 1:
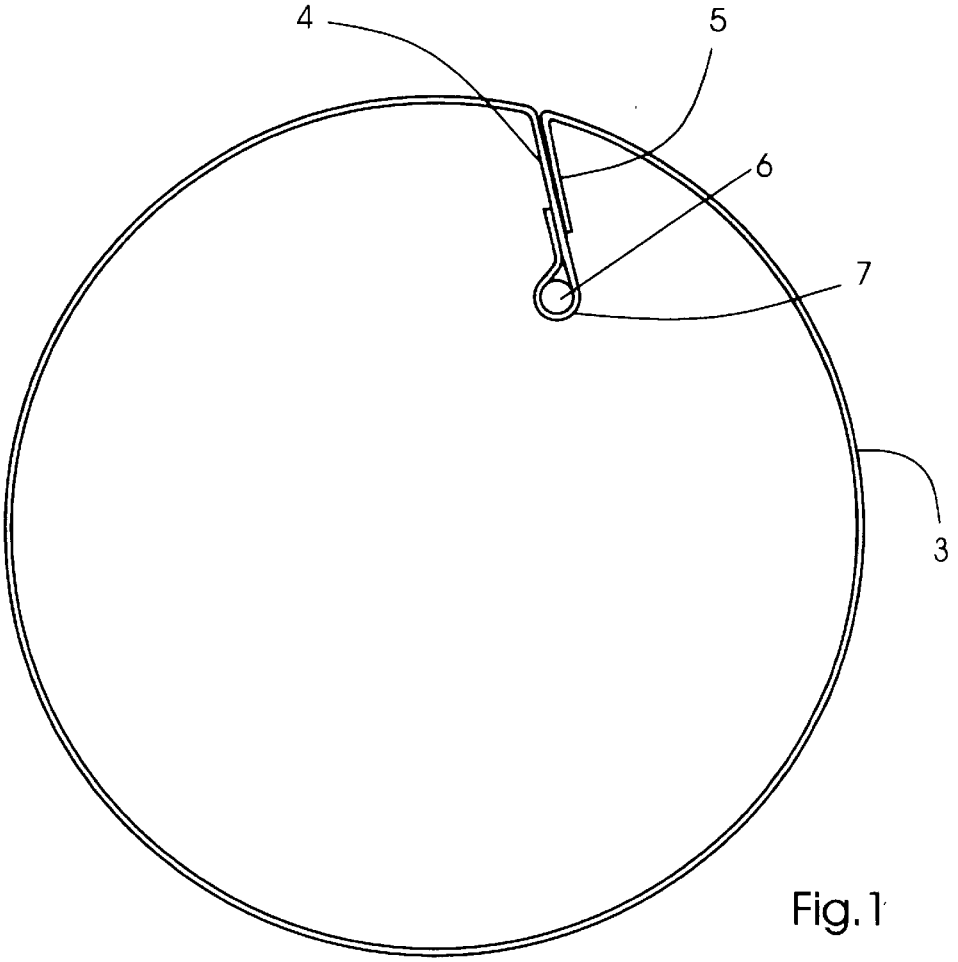
FIG. 1 shows a curved plate made in accordance with the prior art.
Figure 2:
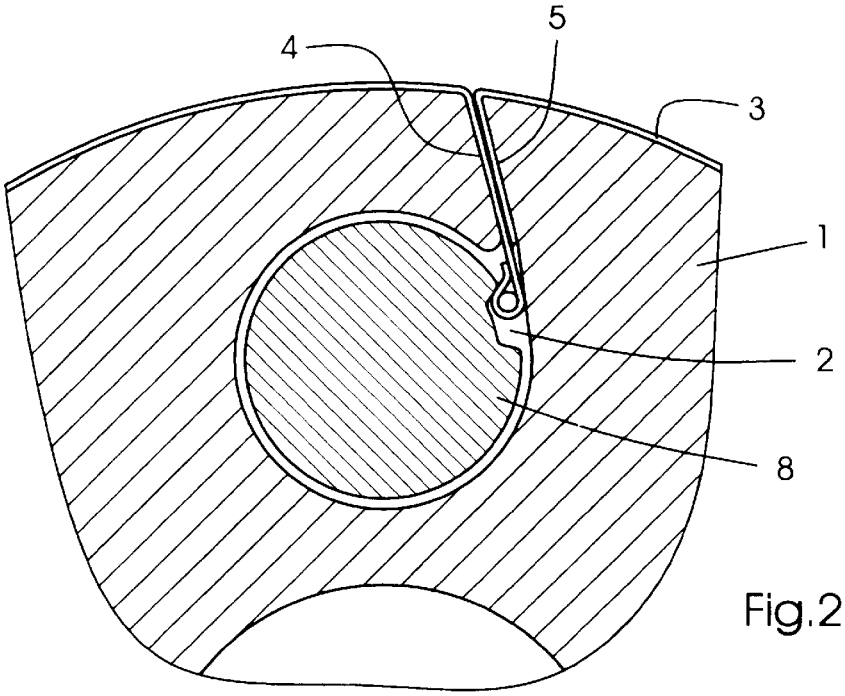
FIG. 2 shows a plate lock-up mechanism of the prior art.
Figure 3:
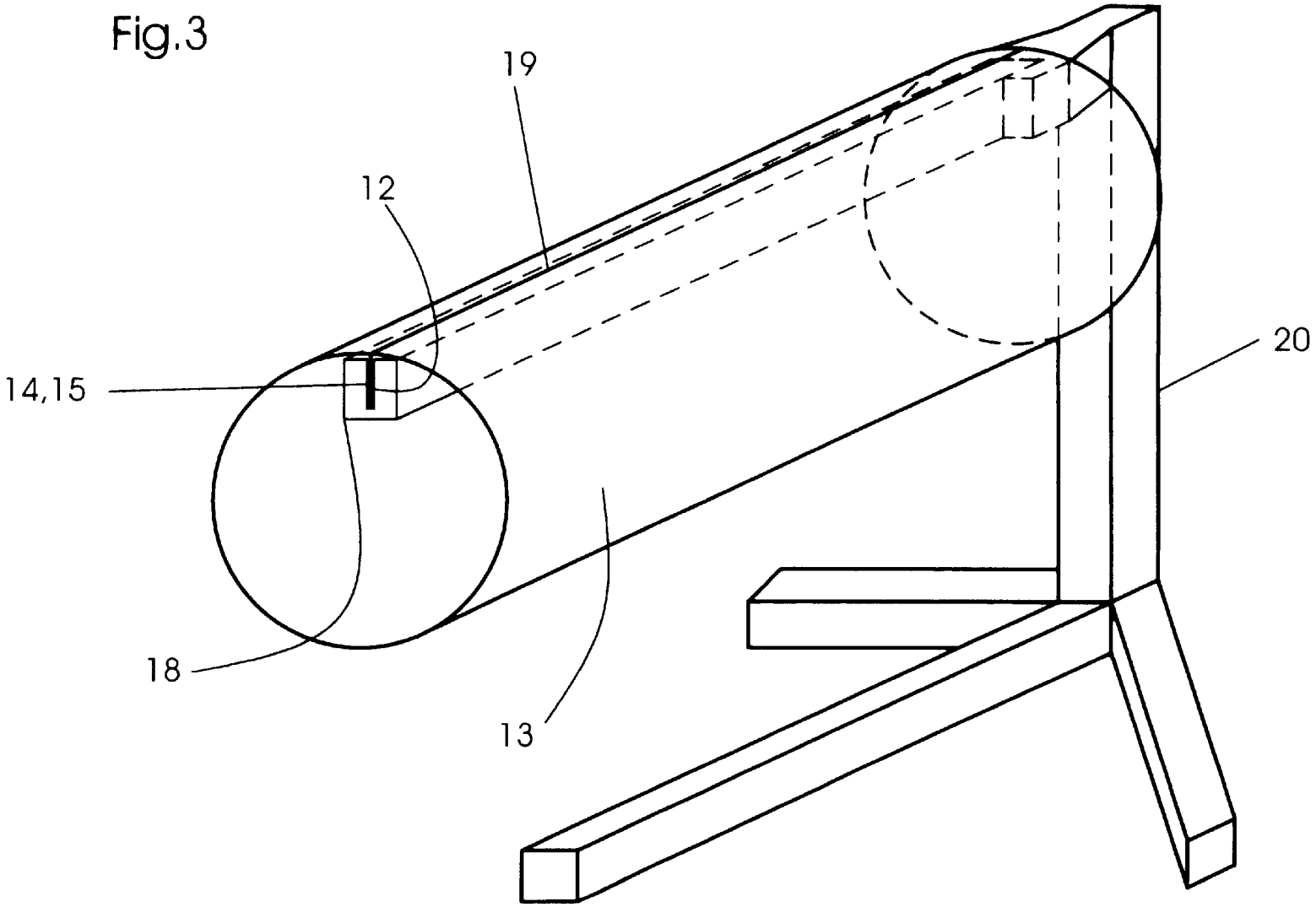
FIG. 3 is a perspective view of a plate, plate lock-up mechanism, and plate lock-up mechanism stand of the present invention.

FIG. 3 shows the present invention during initial lock-up prior to mounting of the plate 13 on a plate cylinder 11. Plate 13, initially flat, has both of its ends 14, 15 bent into an approximately 90° angle, and then plate 13 is formed into an approximately cylindrical shape, with bent ends 14, 15 adjacent and approximately parallel to one another, thereby forming a narrow gap 19 running along the length of the cylindrically-shaped plate 13. To temporarily hold the plate 13 in the cylindrical shape, the ends 14, 15 can be bonded together using any of a variety of known techniques, including gluing, spot welding, or perforation bonding (i.e., punching a hole through both ends so that material from one end is locked into the hole on the other end), etc.

A lock-up mechanism stand 20 is provided, upon which a removable lock-up mechanism 18 is temporarily mounted in a cantilevered fashion during a lock-up operation. Ends 14, 15 of cylindrical plate 13 are inserted into an axial slot 12 in lock-up mechanism 18. As described in more detail below, after insertion of ends 14, 15 into axial slot 12, lock-up mechanism 18 is locked, to lock up cylindrical plate 13 in lock-up mechanism 18. Lock-up mechanism 18 tightly clamps the ends 14, 15 together, thereby reducing the size of the gap 19 extending along the length of the cylindrical plate 13, and thereby holding plate 13 fixed in a cylindrical shape.

After the plate 13 has been locked up by the lock-up mechanism 18, the plate 13 and lock-up mechanism 18 are removed from lock-up mechanism stand 20 and then mounted on the plate cylinder 11. FIGS. 4 and 5 show the process of mounting plate 13 onto the plate cylinder 11. Plate cylinder 13 includes an axial slot 21 extending the full length of plate cylinder 13 and having a width and depth sized to allow insertion of lock-up mechanism 18. On the outer surface of plate cylinder 11 are a series of compressed air outlets 22. Compressed air outlets 22 are connected to radial compressed air feed channels 23, which in turn are connected to a central, axial compressed air feed channel 24. Plate cylinder 11 is mounted at one end 27 to a bearing 25 mounted in a side wall 26 of the press structure. The opposite end 28 of plate cylinder 11 is removably mounted in a bearing (not shown) which swings away from plate cylinder 11 during mounting and removal of plate 13. The manner in which end 28 of plate cylinder 11 is removably mounted is known in the prior art.

During mounting of plate 13 onto plate cylinder 11, compressed air is provided to air feed channels 23, 24, thereby providing air flow out of outlets 22. One end 29 of the plate 13/lock-up mechanism 18 combination is moved in mounting direction M toward the end 28 of plate cylinder 11, such that lock-up mechanism 18 slides into axial slot 21. The compressed air exiting from outlets 22 acts to slightly expand the inner diameter of plate 13, thereby providing clearance between the inner diameter of plate 13 and outer diameter of plate cylinder 11 during the sliding of plate 13 over plate cylinder 11. The compressed air exiting from outlets 23 also provides an air bearing over which the plate 13 slides. Lock-up mechanism 18 is slid down axial slot 21 until the plate 13 completely covers the plate cylinder 13. Thereafter, the supply of compressed air to feed channel 24 is halted, causing the plate 13 to slightly contract onto the outer surface of plate cylinder 11. Thereafter, end 28 is placed in the swing-away bearing (not shown), and the press is thereafter ready for operation.

FIG. 6 shows a first embodiment of a lock-up mechanism 18 of the present invention, in a locked condition. The lock-up mechanism 18 of FIG. 6 includes a fixed jaw 30 on which is slidably mounted a movable jaw 31. Between fixed jaw 30 and movable jaw 31 is mounted an inflatable bladder 32. Interior of inflatable bladder 32 is connected to an inflation channel 33 in fixed jaw 30, which inflation channel 33 terminates in an inflation nipple 34. Inflation nipple 34 includes any known valve (not shown) sufficient to prevent fluid in inflatable bladder 32 from escaping unless manually actuated (e.g., the type of valve used on automobile tires). In operation, ends 14, 15 of plate 13 are inserted in axial slot 12 when inflatable bladder 32 is in an uninflated condition. In the uninflated condition, inflatable bladder 32 is in a collapsed state, and movable jaw 31 is therefore moved away from fixed jaw 30 such that axial slot 12 is relatively wide. After insertion of ends 14, 15 into axial slot 12, a source of compressed fluid, such as air, is attached to inflation nipple 34, causing the inflatable bladder 32 to expand, forcing movable jaw 31 toward ends 14, 15, thereby locking up plate 13 ends 14, 15 between movable jaw 31 and fixed jaw 30.

FIGS. 7 and 7*a* show an end view of a second embodiment of the lock-up mechanism 18 of the present invention. Lock-up mechanism 18 includes jaws 35, 36 pivoted, through pivot 37, to one another. A spring 38, which may be a coil spring mounted on pivot 37 or any other known spring, is provided for biasing jaws 35, 36 toward one another. One jaw includes a spreader hole 39, while the other jaw has pivotally mounted thereon, in a spreader pivot hole 42 a U-shaped spreader pin 40. FIG. 7 shows an end view of spreader pin 40; FIG. 7*a* shows a side view of spreader pin 40. In operation, ends 14, 15 of plate 13 are inserted in axial slot 12 after an end 41 of spreader pin 40 has been inserted into spreader hole 39. Pivoting of spreader pin 40 in spreader pivot hole 42 and insertion of end 41 of spreader pin 40 into spreader hole 39 causes jaws 35, 36 to pivot away from each other, against the bias of spring 38, and spreader pin 40 holds the jaws 35, 36 in this open condition. After insertion of ends 14, 15 into axial slot 12, spreader pin 40 end 41 is removed from spreader hole 39, and the bias of spring 38 forces jaws 35, 36 toward ends 14, 15 and toward one another, thereby locking up plate 13 ends 14, 15 between jaws 35, 36.

FIGS. 8 and 8*a* show a third embodiment of the lock-up mechanism 18 of the present invention, where FIG. 8 shows the lock-up mechanism 18 in a locked condition, and FIG. 8*a* shows the lock-up mechanism 18 in an unlocked condition. The lock-up mechanism of FIGS. 8 and 8*a* includes a fixed jaw 43 and a movable jaw 44 slidably mounted in fixed jaw 43. A cam toggle 45 is pivotally mounted, through pivot 46, to fixed jaw 43. Cam toggle 45 includes an actuating handle 47 and a cam 48, which cam 48 has a center point 49, relative to which pivot 46 is eccentrically mounted. Cam 48 rides in a groove 50 in movable jaw 44. Cam toggle 45 moves from a locked condition (FIG. 8) to an unlocked condition (FIG. 8*a*) by pivoting of actuating handle 47 about pivot 46. In operation, ends 14, 15 of plate 13 are inserted in axial slot 12 when cam toggle 45 is in an unlocked condition (FIG. 8*a*). In the unlocked condition, cam 48 is rotated into a position such that the cooperation of cam 48 and groove 50 causes movable jaw 44 to move away from fixed jaw 43 so that axial slot 12 is relatively wide. After insertion of ends 14, 15 into axial slot 12, cam toggle 45 is moved to the locked condition (FIG. 8) by pivoting actuating handle 47 about pivot 46 toward movable jaw 44. Pivoting of actuating handle toward movable jaw 44 causes cooperation of cam 48 and groove 50 to move movable jaw 44 toward fixed jaw 43. As a result of this movement, movable jaw 44 is forced toward ends 14, 15, thereby locking up plate 13 ends 14, 15 between movable jaw 44 and fixed jaw 43.

Figure 9:
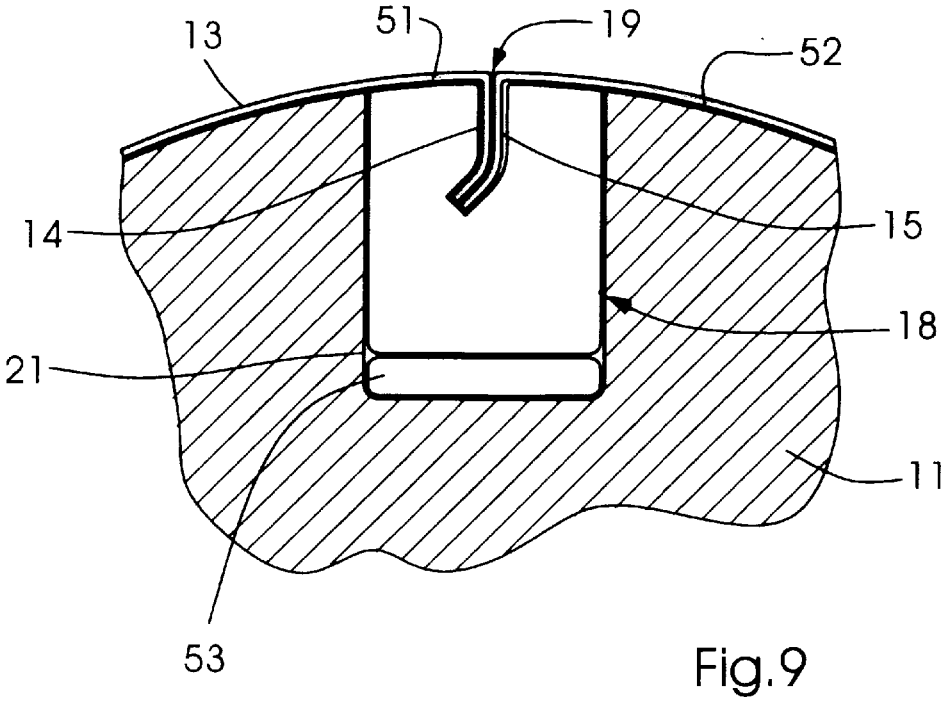
FIG. 9 is an end view of the present invention after mounting on the plate cylinder and showing an adjustment mechanism.

FIG. 9 shows a mechanism for adjusting the location of the lock-up mechanism 18 of the present invention relative to the plate cylinder 11. The lock-up mechanism 18 shown in FIG. 9 is a generic lock-up mechanism 18, and could be any of the lock-up mechanisms 18 shown in FIGS. 6–8*a*.

After lock-up mechanism 18 has been inserted into axial slot 21, it is necessary to ensure that upper surface 51 of lock-up mechanism 18 is concentric with outer surface 52 of plate cylinder 11. To do so, shims or adjustment fillers 53 may be inserted between the bottom of axial slot 21 and the lock-up mechanism 18. In the alternative, the bottom of axial slot 21 could be adjustable so that it may move radially to adjust the radial location of surface 51.

Figure 10:
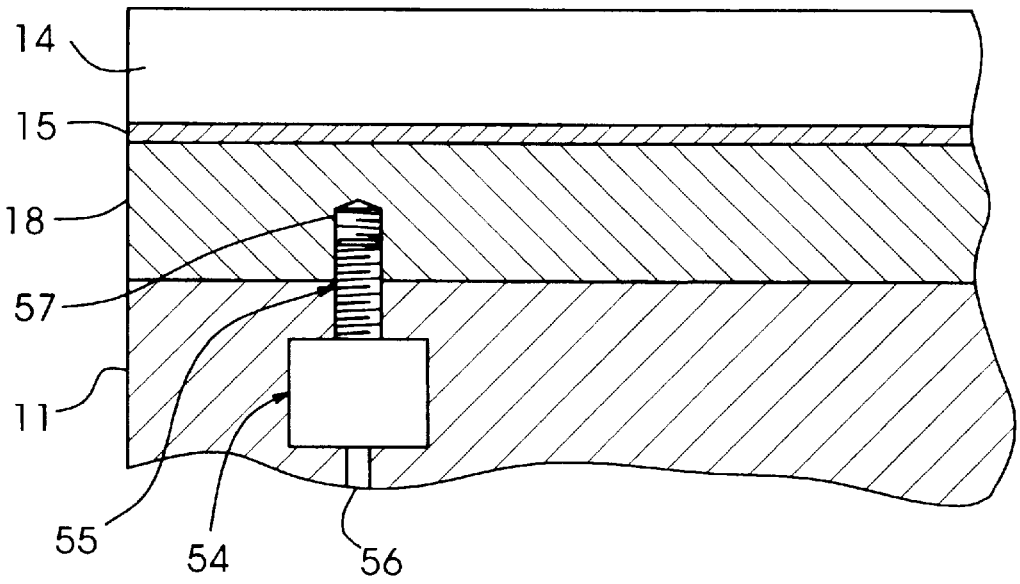
FIG. 10 is a cross-sectional side view of the present invention, showing a first embodiment of a plate tightening mechanism.

FIG. 10 shows a mechanism for tightening the plate 13 on the outer surface 52 of plate cylinder 11. FIG. 10 is a cross-sectional view through the gap 19. Mounted within the plate cylinder 11 is an air motor 54 which turns an adjustment screw 55 projecting into axial slot 21. Air motor 54 is connected to a channel 56, which channel 56 is connected to a source of compressed air. When compressed air is supplied to air motor 54, adjustment screw 54 turns. Lock-up mechanism 18 includes an adjustment hole 57 with screw threads which mate with the screw threads on adjustment screw 55. In operation, lock-up mechanism 18 is inserted into axial slot 21 until adjustment screw 55 is aligned with adjustment hole 57. Thereafter, air motor 54 is actuated to rotate adjustment screw 55. Adjustment screw 55 engages adjustment hole 57 and pulls lock-up mechanism 18 downwardly, fixing lock-up mechanism 18 in axial slot 21 and tightening plate 13 on plate cylinder 11.

Figure 11:
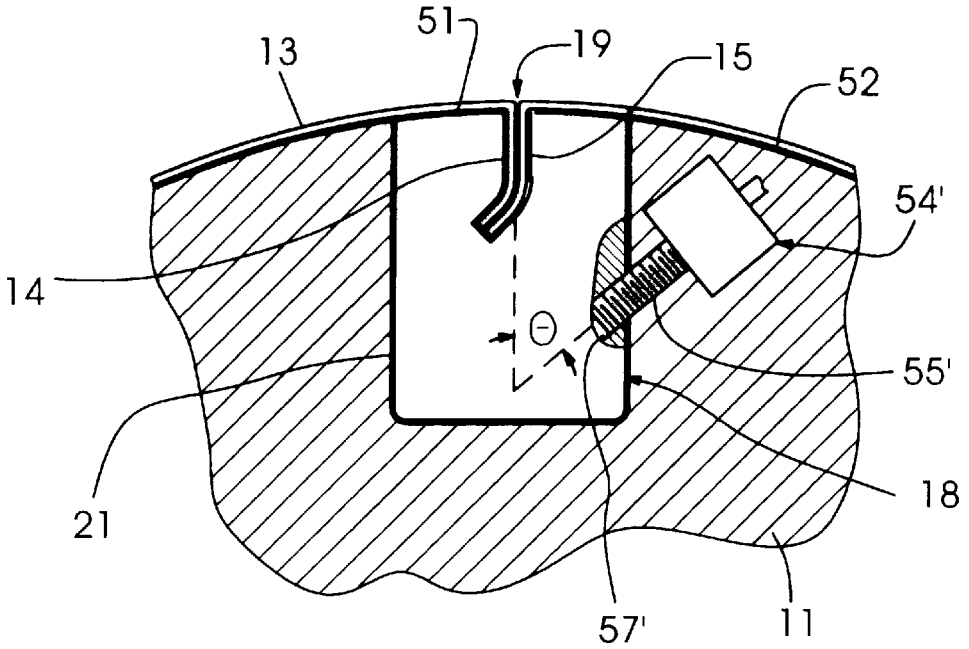
FIG. 11 is a partially cross-sectional end view of a second embodiment of a plate tightening mechanism.

FIG. 11 shows another embodiment for tightening the plate 13 on the outer surface 52 of plate cylinder 11. FIG. 10 is a cross-sectional view through the gap 19. Mounted within the plate cylinder 11 is an air motor 54' which turns an adjustment screw 55' projecting into axial slot 21 at an angle θ from a radius of plate cylinder 11. Angle θ is less than 90°, and preferably in the range of 10°–15°. Air motor 54' is connected to a channel (not shown), which channel is connected to a source of compressed air. When compressed air is supplied to air motor 54', adjustment screw 54' turns. Lock-up mechanism 18 includes an adjustment hole 57' with screw threads which mate with the screw threads on adjustment screw 55'. In operation, lock-up mechanism 18 is inserted into axial slot 21 until adjustment screw 55' is aligned with adjustment hole 57'. Thereafter, air motor 54' is actuated to rotate adjustment screw 55'. Adjustment screw 55' engages adjustment hole 57' and pushes lock-up mechanism 18 downwardly, fixing lock-up mechanism 18 in axial slot 21 and tightening plate 13 on plate cylinder 11. It is to be understood that the tightening mechanisms shown in FIGS. 10 and 11 could be used with any of the lock-up mechanisms shown in any of the embodiments herein, and in particular could be used with the differently-shaped lock-up mechanisms described below.

Figure 12:
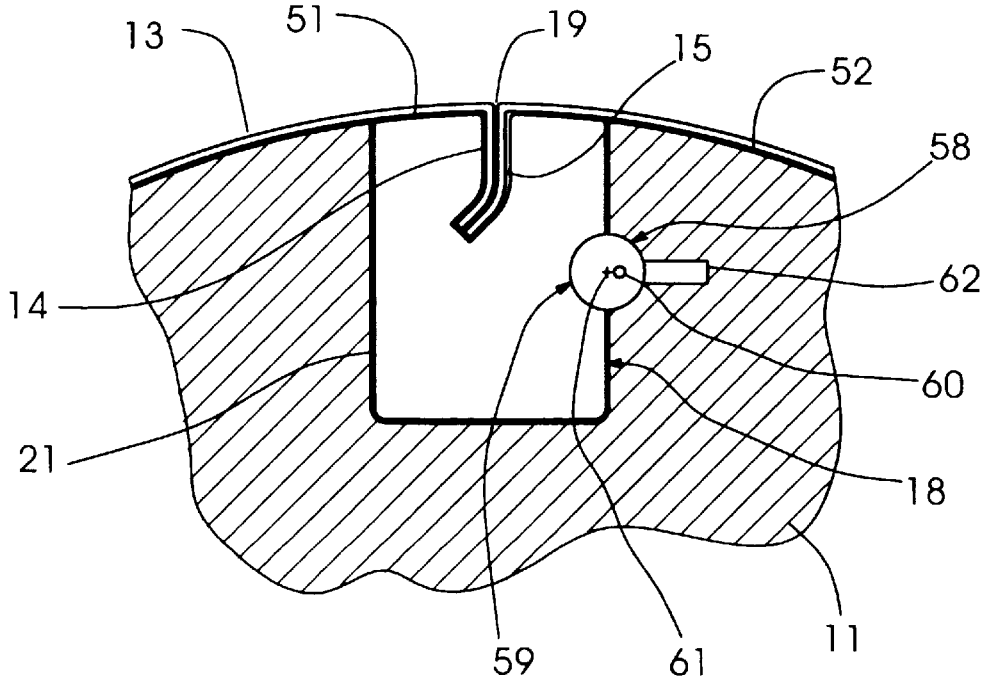
FIG. 12 is an end view of a fourth embodiment of a lock-up mechanism of the present invention.

FIG. 12 shows an embodiment of a mechanism for securing a lock-up mechanism 18 in axial slot 21. Plate cylinder 11 includes a cam mechanism 58 mounted thereon at a location adjacent to axial slot 21. Lock-up mechanism 18 includes a lengthwise slot 59 into which a portion of cam mechanism 58 fits when lock-up mechanism 18 is mounted in axial slot 21. Cam mechanism 58 is mounted for rotation in plate cylinder 11 about an axis 60 which is spaced from the centerpoint 61 of cam mechanism 58. Cam mechanism 58 can include a lever 62 for rotating cam mechanism 58 from a locked to an unlocked position. In operation of cam mechanism 58, cam mechanism 58 is rotated to an unlocked position, and lock-up mechanism 18 is inserted into axial slot 21. Thereafter, cam mechanism 58 is rotated into its locked position, causing cam mechanism 58 to move into slot 59 and forcing lock-up mechanism 18 against an opposite wall of slot 21, thereby securing lock-up mechanism 18 in slot 21. It is to be understood that lock-up mechanism 18 in FIG. 12 can be of any of the types shown and described above and below.

Figure 13:
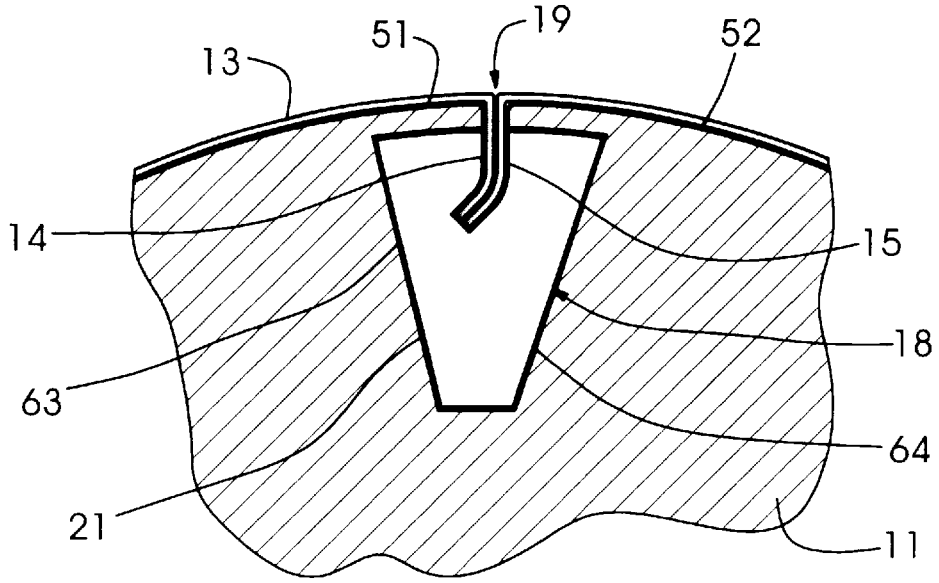
FIG. 13 is an end view of a fifth embodiment of a lock-up mechanism of the present invention.
Figure 14:
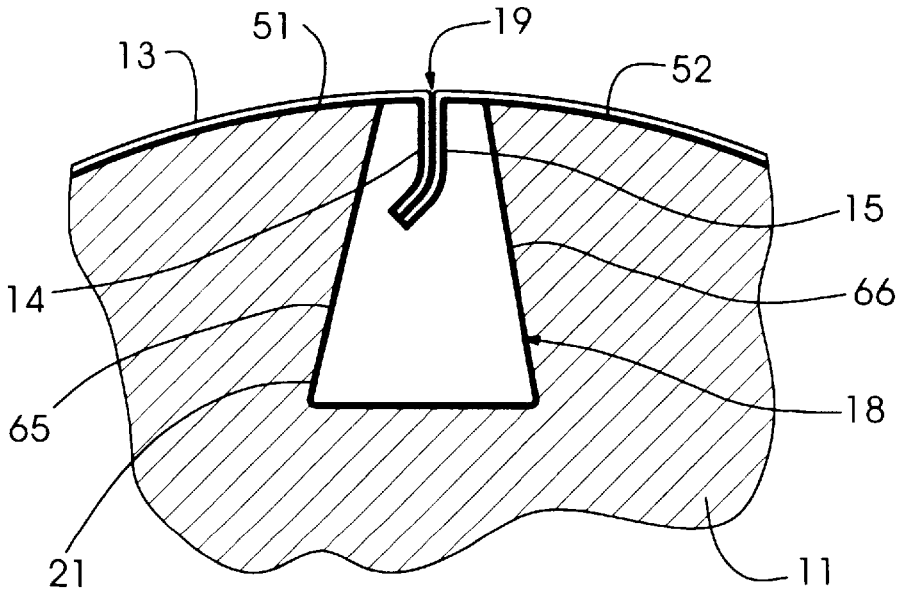
FIG. 14 is an end view of a sixth embodiment of a lock-up mechanism of the present invention.
Figure 15:
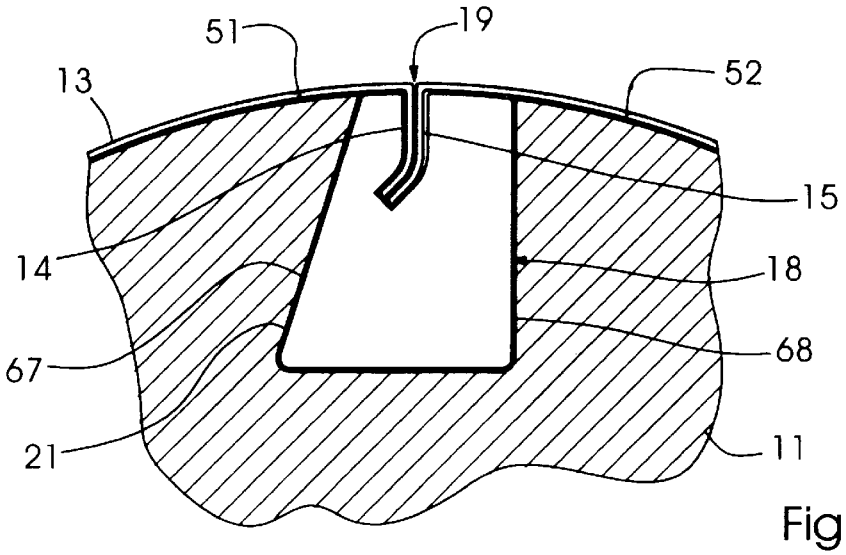
FIG. 15 is an end view of a seventh embodiment of a lock-up mechanism of the present invention.

FIG. 13 shows an alternative embodiment of a lock-up mechanism 18 of the present invention. The lock-up mechanism 18 of FIG. 13 can be of any of the types shown and described above and below, but includes sides 63, 64 which taper inwardly in the radially inward direction. The axial slot 21 contains similarly tapered walls. A tightening and/or securing mechanism of the types described above or below used with the lock-up mechanism 18 of FIG. 13. Engagement of the tightening and/or securing mechanism forces one of sides 63, 64 against the corresponding tapered wall of axial slot 21, causing lock-up mechanism 18 to move slightly radially inwardly, thereby tightening the plate 13 and securing lock-up mechanism 18 into plate cylinder 11. FIG. 14 shows an alternative embodiment in which the sides 65, 66 are tapered outwardly in the radially inward direction, and the axial slot 21 contains similarly tapered walls. In the embodiment of FIG. 14, the tightening and/or securing mechanism is of the types described above or below. Engagement of the tightening and/or securing mechanism forces one of sides 63, 64 against the corresponding tapered wall of axial slot 21, causing lock-up mechanism 18 to move slightly radially outwardly, thereby securing lock-up mechanism 18 into plate cylinder 11. FIG. 15 shows a further alternative embodiment with a lock-up mechanism 18 including one outwardly tapered side wall 67 and one radial side wall 68.

Figure 16:
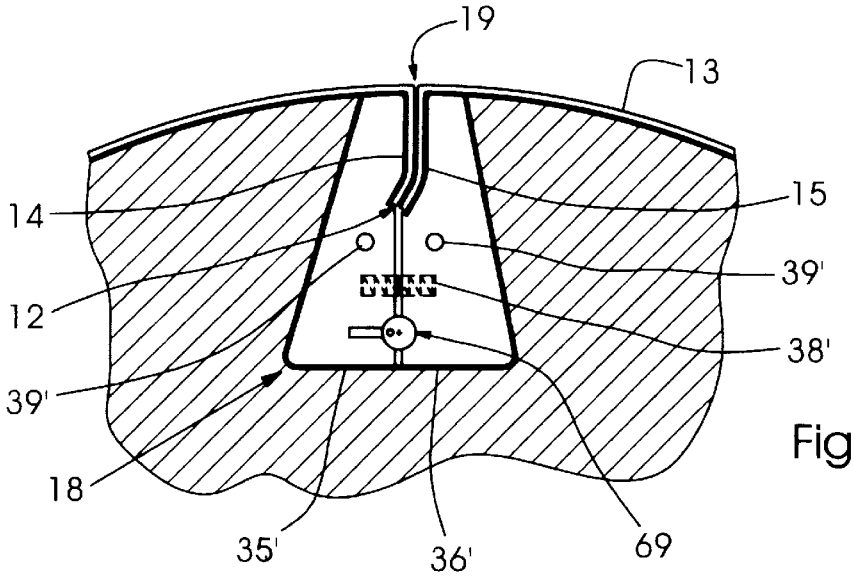
FIG. 16 is an end view of a eighth embodiment of a lock-up mechanism of the present invention.
Figure 17:
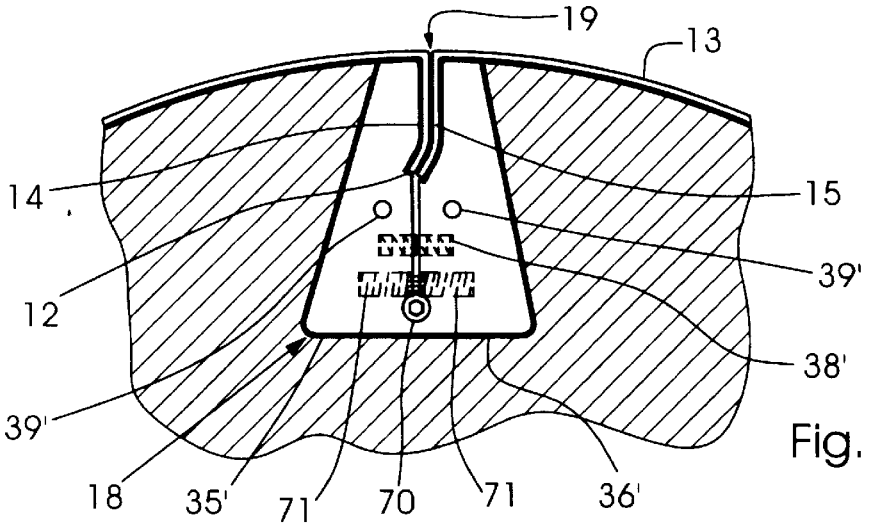
FIG. 17 is an end view of a ninth embodiment of a lock-up mechanism of the present invention.

FIGS. 16 and 17 show further embodiments of a lock-up mechanism 18 of the present invention. The embodiments of FIGS. 16 and 17 are similar to the embodiment of FIGS. 7 and 7*a,* in that they include jaws 35', 36' which move relative to one another to clamp the ends 14, 15 of plate 13. A spring 38', which may be a coil spring mounted between jaws 35', 36', is provided for biasing jaws 35', 36' toward one another. Jaws includes spreader holes 39', into which a U-shaped spreader pin (not shown) is inserted during insertion of ends 14, 15 of plate 13 in axial slot 12. After insertion of ends 14, 15 into axial slot 12, the spreader pin is removed from spreader holes 39', and the bias of spring 38' forces jaws 35', 36' toward ends 14, 15 and toward one another, thereby locking up plate 13 ends 14, 15 between jaws 35', 36'. Thereafter, the lock-up mechanism 18 is inserted into the axial slot of the plate cylinder. The jaws 35', 36' include side walls which are tapered outwardly in a radially inward direction. Mounted between jaws 35', 36' is a securing mechanism including a cam mechanism 69. After insertion of locking mechanism 18 into the axial slot, the cam mechanism 69 is rotated to a securing position. This movement of cam mechanism causes jaws 35', 36' to spread slightly apart, thereby wedging the tapered sides of the jaws 35', 36' against the corresponding side walls of the slot, securing the lock-up mechanism 18 in the slot. FIG. 17 shows an alternative embodiment of the securing mechanism; in all other respects the embodiment of FIG. 17 is identical to the embodiment of FIG. 16. In FIG. 17, the securing mechanism includes an axial turning mechanism 70, which may include a hex/Allen wrench engagement at the end. Rotation of turning mechanism 70 causes rotation of lateral screws 71. Rotation of lateral screws 71, which lateral screws 71 mate with lateral screw-threaded holes in jaws 35', 36', causes the jaws 35', 36' to spread slightly apart, thereby wedging the tapered sides of the jaws 35', 36' against the corresponding side walls of the slot, securing the lock-up mechanism 18 in the slot.

From the above description of the invention, those skilled in the art will perceive improvements, changes and modifications. Such improvements, changes and modifications within the skill of the art are intended to be covered by the appended claims.

What is claimed is:

1. An apparatus in a printing press, comprising:

a printing plate, the printing plate comprising at least two ends;

a plate cylinder, the plate cylinder comprising an axial slot; and a lock-up mechanism, the lock-up mechanism comprising at least one movable jaw movable from a locked condition to an unlocked condition, the lock-up mechanism locking up the ends of the printing plate in the lock-up mechanism in the locked condition of the movable jaw, the lock-up mechanism being removably mountable in the axial slot, whereby the lock-up mechanism locks up the ends of the printing plate prior to mounting of the lock-up mechanism in the axial slot.

2. A method of mounting a printing plate in a printing press, comprising:

providing an initially flat printing plate;

providing a plate cylinder comprising an axial slot;

providing a lock-up mechanism comprising at least one movable jaw movable from a locked condition to an unlocked condition, the lock-up mechanism being removably mountable in the axial slot;

removing the lock-up mechanism from the plate cylinder;

bending ends of the printing plate;

forming the printing plate into an approximately cylindrical shape wherein the bent ends of the printing plate are approximately parallel;

inserting the bent ends of the printing plate in the lock-up mechanism;

locking up the printing plate in the lockup mechanism by moving the at least one movable jaw to the locked condition; and mounting the lock-up mechanism in the axial slot.

3. The method of claim 2, further comprising the steps of:

providing a lock-up mechanism stand; and mounting the lock-up mechanism on the lock-up mechanism stand during the step of locking up of the ends of the printing plate and prior to the step of mounting the lock-up mechanism in the axial slot.

4. The method of claim 2, wherein:

an outer surface of the plate cylinder comprises a plurality of fluid outlets, and further comprising the step of expanding the inner diameter of the printing plate by connecting the fluid outlets to a source of compressed air during the step of mounting the lock-up mechanism in the axial slot.

5. The method of claim 2, further comprising the step of:

adjusting the radial location of the lock-up mechanism in the axial slot after the step of mounting the lock-up mechanism in the axial slot.

6. The method of claim 2, further comprising the step of:

tightening the printing plate on the plate cylinder after the step of mounting the lock-up mechanism in the axial slot.

7. The method of claim 2, further comprising the step of:

securing the lock-up mechanism to the plate cylinder after the step of mounting the lock-up mechanism in the axial slot.

8. An apparatus for mounting a printing plate in a printing press, comprising:

a plate cylinder, the plate cylinder comprising an axial slot; and a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot, wherein the lock-up mechanism has at least one side which tapers outwardly in the radially inward direction, and wherein the axial slot has at least one side wall which tapers outwardly in the radially inward direction.

9. The apparatus of claim 8, wherein:

the lock-up mechanism has two sides which taper outwardly in the radially inward direction, and wherein the axial slot has two side walls which taper outwardly in the radially inward direction.

10. An apparatus for mounting a printing plate in a printing press, comprising:

a plate cylinder, the plate cylinder comprising an axial slot; and a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot, wherein the lock-up mechanism has at least one side which tapers inwardly in the radially inward direction, and wherein the axial slot has at least one side wall which tapers inwardly in the radially inward direction.

11. The apparatus of claim 10, wherein:

the lock-up mechanism has two sides which taper inwardly in the radially inward direction, and wherein the axial slot has two side walls which taper inwardly in the radially inward direction.

12. An apparatus for mounting a printing plate in a printing press, comprising:

a plate cylinder, the plate cylinder comprising an axial slot;

a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot; and a lock-up mechanism stand, the lock-up mechanism being mounted on the lock-up mechanism stand during locking up of the ends of the printing plate and prior to mounting of the lock-up mechanism in the axial slot.

13. An apparatus for mounting a printing plate in a printing press, comprising:

a plate cylinder, the plate cylinder comprising an axial slot, wherein an outer surface of the plate cylinder comprises a plurality of fluid outlets, and wherein the fluid outlets are connected to a source of compressed fluid; and a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot.

14. The apparatus of claim 13, wherein:

the compressed fluid is air.

15. An apparatus for mounting a printing plate in a printing press, comprising:

a plate cylinder, the plate cylinder comprising an axial slot; and a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot, wherein the lock-up mechanism comprises a fixed jaw, the at least one movable jaw being movably mounted on the fixed jaw.

16. The apparatus of claim 15, wherein:

the lock-up mechanism comprises an inflatable bladder mounted between the fixed jaw and the at least one movable jaw, the inflatable bladder being inflated in the locked condition and the inflatable bladder being deflated in the unlocked condition.

17. The apparatus of claim 15, wherein:

the lock-up mechanism comprises a cam toggle, the cam toggle comprising a cam, the cam toggle moving the at least one movable jaw from the locked condition to the unlocked condition.

18. An apparatus for mounting a printing plate in a printing press, comprising:

a plate cylinder, the plate cylinder comprising an axial slot; and a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot, wherein the lock-up mechanism comprises a second jaw, the at least one movable jaw being movably mounted to the second jaw.

19. The apparatus of claim 18, wherein:

the first and second jaws are pivotally mounted to one another.

20. The apparatus of claim 18, wherein:

the lock-up mechanism comprises a spring, the spring biasing the at least one movable jaw and the second jaw toward one another and toward the locked condition.

21. The apparatus of claim 20, wherein:

the lock-up mechanism comprises a spacer pin, the spacer pin holding the at least one movable jaw and the second jaw away from one another and toward the unlocked condition.

22. The apparatus of claim 18, wherein:

the lock-up mechanism comprises a spreader mechanism for spreading the first and second jaws apart after insertion of the lock-up mechanism in the axial slot.

23. The apparatus of claim 22, wherein:

the spreader mechanism comprises a cam mechanism mounted between the first and second jaws.

24. The apparatus of claim 22, wherein:

the spreader mechanism comprises an axial turning device and at least one lateral screw.

25. An apparatus for mounting a printing plate in a printing press, comprising:

a plate cylinder, the plate cylinder comprising an axial slot;

a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot; and an adjustment filler mounted between the axial slot and the lock-up mechanism, the adjustment filler adjusting the radial location of the lock-up mechanism in the axial slot.

26. An apparatus for mounting a printing plate in a printing press, comprising:

a plate cylinder, the plate cylinder comprising an axial slot;

a lock-up mechanism, the lock-up mechanism comprising at least one movable jaw movable from a locked condition to an unlocked condition, the lock-up mechanism locking up ends of the printing plate in the locked condition, the lock-up mechanism being removably mountable in the axial slot, whereby the lock-up mechanism locks up the ends of the printing plate prior to mounting of the lock-up mechanism in the axial slot; and a tightening mechanism, the tightening mechanism being mounted on the plate cylinder, the tightening mechanism tightening the printing plate on the plate cylinder.

27. The apparatus of claim 26, wherein:

the tightening mechanism comprises at least one screw and the lock-up mechanism comprises at least one hole, the at least one screw mating with the at least one hole.

28. The apparatus of claim 27, wherein:

the tightening mechanism further comprises as least one motor for rotating the at least one screw.

29. The apparatus of claim 27, wherein:

the at least one screw is mounted at an angle to a radius of the plate cylinder.

* * * * *